US006496677B2

(12) United States Patent
Fujimori

(10) Patent No.: US 6,496,677 B2
(45) Date of Patent: Dec. 17, 2002

(54) IMAGE FORMING APPARATUS AND IMAGE FORMING METHOD

(75) Inventor: Kouta Fujimori, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/842,863

(22) Filed: Apr. 27, 2001

(65) Prior Publication Data

US 2002/0003975 A1 Jan. 10, 2002

(30) Foreign Application Priority Data

Apr. 27, 2000 (JP) ..... 2000-126757
Apr. 6, 2001 (JP) ..... 2001-108253

(51) Int. Cl.[7] ..... G03G 15/01; G03G 15/16
(52) U.S. Cl. ..... 399/298; 399/66; 399/302
(58) Field of Search ..... 399/298, 299, 399/302, 66, 49, 46

(56) References Cited

U.S. PATENT DOCUMENTS

| | | | | |
|---|---|---|---|---|
| 5,245,385 A | | 9/1993 | Fukumizu et al. | 399/91 |
| 5,289,147 A | | 2/1994 | Koike et al. | 399/1 |
| 5,367,363 A | | 11/1994 | Kai et al. | 399/113 |
| 5,400,123 A | | 3/1995 | Sato et al. | 399/187 |
| 5,630,195 A | | 5/1997 | Sawayama et al. | 399/49 |
| 5,678,150 A | | 10/1997 | Takahashi et al. | 399/299 |
| 5,761,570 A | | 6/1998 | Sawayama et al. | 399/49 |
| 5,784,677 A | | 7/1998 | Tamura et al. | 399/302 |
| 5,860,038 A | | 1/1999 | Kato et al. | 399/49 |
| 5,930,556 A | * | 7/1999 | Imamiya | 399/66 |
| RE36,301 E | | 9/1999 | Kai et al. | 399/113 |
| 6,055,386 A | | 4/2000 | Kato et al. | 399/49 |
| 6,061,542 A | * | 5/2000 | Minami et al. | 399/299 |
| 6,125,257 A | | 9/2000 | Sekine et al. | 399/343 |
| 6,134,402 A | * | 10/2000 | Nakayama et al. | 399/299 X |
| 6,160,569 A | | 12/2000 | Fujimori et al. | 347/262 |
| 6,249,656 B1 | * | 6/2001 | Watanabe et al. | 399/66 |
| 6,334,039 B1 | * | 12/2001 | Yoshinaga et al. | 399/298 |

FOREIGN PATENT DOCUMENTS

| | | | |
|---|---|---|---|
| EP | 0 856 783 | | 8/1998 |
| JP | 11-102091 | | 4/1999 |
| JP | 2001-027852 | * | 1/2001 |

OTHER PUBLICATIONS

Patents Abstracts of Japan, JP 2000–131967, May 12, 2000.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus of a tandem method includes a conveying member configured to provide to a recording member a conveying force in a sub-scanning direction, a plurality of image carriers configured to contact the conveying member with an equal interval between contacting portions of the plurality of image carriers and the conveying member, a contact force adjusting mechanism configured to freely adjust a contact force of the conveying member to the plurality of image carriers between a predetermined contact force and a decreased contact force, a plurality of toner image forming devices configured to form toner images of a predetermined pattern on the plurality of image carriers respectively. A length of the pattern in the sub-scanning direction is set shorter than a length of the equal interval. The apparatus also includes transferring devices configured to transfer the toner images on the plurality of image carriers onto the conveying member, respectively; and a contact force changing device configured to change the predetermined contact force to the decreased contact force before respective tips of the toner images on the conveying member pass subsequent contacting portions, so that respective parts of the toner images are not transferred onto subsequent image carriers.

26 Claims, 8 Drawing Sheets

FIG. 4

37

| 37a | 37b |
|---|---|
| P(=P2/P1) | CORRECTING VALUE |
| P≧0.95 | +50V |
| 0.95>P≧0.80 | +100V |
| P<0.80 | +200V |

FIG. 5

38

| 38a | | |
|---|---|---|
| PATTERN NO. | Vd | Vb |
| 1 | −300 | −100 |
| 2 | −400 | −200 |
| 3 | −500 | −300 |
| 4 | −520 | −320 |
| 5 | −600 | −400 |
| 6 | −700 | −500 |
| 7 | −800 | −600 |

IMAGE FORMING APPARATUS AND IMAGE FORMING METHOD

BACKGROUND OF THE INVENTION

1. Field of the Invention

The present invention relates to an image forming apparatus, such as a color copying machine, a printer, and a facsimile machine, of a tandem method.

2. Discussion of the Background

A known image forming apparatus, for example a color copying machine of a tandem method, which has an image forming mechanism including a conveying belt which is rotated in a sub-scanning direction and plural image carriers which the conveying belt is brought into contact by a predetermined contact force.

The image forming mechanism includes, for each image carrier, a charging device which uniformly charges the surface of the image carrier, an exposing device which forms an electrostatic latent image by exposing a predetermined image, a developing device which forms a predetermined toner image by making a developer containing a toner of each color adhere to the electrostatic latent image, and a transferring device which transfers the toner image onto a sheet conveyed on a conveying surface of the conveying belt by applying a transferring bias between the image carrier and the transferring device.

In such an image forming apparatus, it has been known that image densities of toner images of a predetermined pattern, which are directly transferred from the plural image carriers onto the conveying belt at a predetermined timing, are respectively detected, and on the basis of the detection results, image forming conditions, such as developing biases by the developing devices or transferring biases by the transferring devices etc., are respectively set for the plural image carriers.

With respect to detection of the image densities of such toner images for setting the image forming conditions, there is known an image forming apparatus in which one density sensor is installed at the downstream side of the image carrier positioned at the most downstream side in a sheet conveying direction, and the densities of the toner images which are transferred from respective image carriers onto the conveying belt are detected by the density sensor. In the image forming apparatus, detection of the image densities of plural toner images on the conveying belt transferred from the plural image carriers by an inexpensive structure has been enabled by realizing detection of the image densities of the toner images with one sensor.

Further, there is known an image forming apparatus in which toner images on image carriers are transferred onto a sheet which is conveyed on the conveying surface of a conveying belt by way of an intermediate transfer belt. In such an image forming apparatus, the image densities of the toner images of a predetermined pattern are detected at predetermined timings, and image forming conditions such as developing biases by developing devices or transferring biases by transferring devices are set on the basis of the detection results.

Further, there has been known an image forming apparatus in which plural density sensors are installed for respective image carriers, and the image densities of toner images which have been transferred from respective image carriers onto a conveying belt are detected immediately after having been transferred. In this image forming apparatus, highly reliable detection values can be obtained by detecting the image densities of the toner images immediately after the toner images have been transferred from the respective image carriers.

In the image forming apparatus in which the density sensor is installed at the downstream side of the image carrier positioned at the most downstream side in the sheet conveying direction, detection of the image densities of toner images on the conveying belt (an intermediate transfer member) has been realized by an inexpensive structure. However, the toner images on the conveying belt other than the one which has been transferred from the image carrier positioned at the most downstream side in the sheet conveying direction, pass the contacting portions between the image carriers and the conveying belt (the intermediate transfer belt), which are at downstream side of the respective transferring portions, and therefore what is called a reverse transfer of toner occurs, such that the toner which has been transferred onto the conveying belt (the intermediate transfer belt) once is transferred onto the image carrier again. Thus, there is a possibility that the image densities detected by the image sensor are the ones of the toner images in which the reverse transfer has occurred, reducing reliability in the detected image densities of the toner images.

When the image forming operation is performed under image conditions set according to the image densities of reduced reliability, the reproducibility of the formed image is decreased.

In the image forming apparatus in which the plural density sensors are installed for respective image carriers, the highly reliable image densities of the toner images can be obtained; however, the cost of the apparatus is increased because the density sensors are installed for respective image carriers.

In addition, Japanese Laid-Open Patent Publication No. 11-102091 discloses an image forming apparatus in which density sensors are installed at the upstream side and the downstream side in the moving direction of the conveying surface of a conveying belt for respective image carriers in order to consider the amount of a reverse transfer of a toner image, and image forming conditions are set according to the image densities of toner images which have been detected by those density sensors before and after transferring. However, according to the technique disclosed in the above publication, although it is possible to set the image forming conditions considering the reverse (repeated) transfer, the cost of an apparatus is increased because the plural density sensors are installed for respective image carriers.

SUMMARY OF THE INVENTION

Accordingly, preferred embodiments of the present invention provide an image forming apparatus that forms an image of high reproducibility, without being influenced by a so called reverse transfer of toner, by an inexpensive structure.

According to a preferred embodiment of the present invention, an image forming apparatus of a tandem method, includes, a conveying member configured to provide to a recording member a conveying force in a sub-scanning direction, a plurality of image carriers configured to contact the conveying member with an equal interval between contacting portions of the plurality of image carriers and the conveying member, a contact force adjusting mechanism configured to freely adjust a contact force of the conveying member to the plurality of image carriers between a predetermined contact force and a decreased contact force, a plurality of toner image forming devices configured to form toner images of a predetermined pattern on the plurality of image carriers respectively, a length of the pattern in the sub-scanning direction being set shorter than a length of the equal interval between the contacting portions of the conveying member and the plurality of image carriers, a plurality of transferring devices configured to transfer the toner images on the plurality of image carriers onto the conveying member, respectively, and a contact force changing device configured to change the predetermined contact force by the contact force adjusting mechanism to the decreased contact force before respective tips of the toner images on the conveying member pass subsequent contacting portions of the contacting portions between the plurality of image carriers and the conveying member, so that respective parts of the toner images on the conveying member are not transferred back onto subsequent image carriers of the plurality of image carriers.

Further, the image forming apparatus further includes, an image density detecting device configured to detect image densities of the toner images on the conveying member, and an image forming condition setting device configured to set an image forming condition on a basis of the image densities detected by the image density detecting device.

Further, the image density detecting device detects the image densities of the toner images on the conveying member before and after the predetermined contact force by the contact force adjusting mechanism is changed to the decreased contact force, and the image forming condition setting device sets the image forming condition on a basis of the image densities detected by the image density detecting device before and after the predetermined contact force by the contact force adjusting mechanism is changed to the decreased contact force.

Further, the plurality of transferring devices transfer the toner images by applying transferring biases between the conveying member and the plurality of image carriers respectively, and the image forming condition setting device sets respective electric potential strengths of the transferring biases.

Further, the plurality of toner image forming devices include the plurality of developing devices holding developer including toner, and form respectively the toner images by making the developer adhere to the plurality of image carriers by applying developing biases between the plurality of developing devices and the plurality of image carriers respectively, and the image forming condition setting device sets respective electric potential strengths of the developing biases between the plurality of developing devices and the plurality of image carriers.

Further, the plurality of toner image forming devices include plurality of toner containers containing toner and plurality of developing devices holding developer including the toner supplied from the plurality of toner containers, and form the toner images by making the developer adhere to the plurality of image carriers by applying developing biases between the plurality of developing devices and the plurality of image carriers respectively, and the image forming condition setting device sets respective toner amounts supplied from the plurality of toner containers to the plurality of developing devices.

According to another preferred embodiment of the present invention, an image forming apparatus of a tandem method, includes, an intermediate transfer member configured to rotate in a sub-scanning direction and to intermediately carry toner images to be transferred onto the recording member, arranged to oppose a conveyed recording member, a plurality of image carriers configured to contact the intermediate transfer member with an equal interval between contacting portions of the plurality of image carrier and the intermediate transfer member, a contact force adjusting mechanism configured to freely adjust a contact force of the intermediate transfer member to the plurality of image carriers between a predetermined contact force and a decreased contact force, a plurality of toner image forming devices respectively configured to form toner images of a predetermined pattern on the plurality of image carriers respectively, a length of the pattern in the sub-scanning direction being set shorter than a length of the equal interval between the contacting portions of the intermediate transfer member and the plurality of image carriers, a plurality of transferring devices configured to transfer the toner images on the plurality of image carrier onto the intermediate transfer member respectively, and a contact force changing device configured to change the predetermined contact force by the contact force adjusting mechanism to the decreased contact force before respective tips of the toner images on the intermediate transfer member respectively pass subsequent contacting portions of the contacting portions between the plurality of image carriers and the intermediate transfer member, so that respective parts of the toner images on the intermediate transfer member are not transferred back onto corresponding subsequent image carriers of the plurality of image carriers.

According to a preferred embodiment of the present invention, a method of forming an image with an image forming apparatus of a tandem method including a conveying member to provide to a recording member a conveying force in a sub-scanning direction, and a plurality of image carriers configured to contact the conveying member at a predetermined contact force with an equal interval between contacting portions of the plurality of image carrier and the conveying member, the method includes, forming toner images of a predetermined pattern on the plurality of image carriers respectively, a length of the pattern in the sub-scanning direction being set shorter than a length of the equal interval between the contacting portions of the conveying member and the plurality of image carriers, transferring the toner images onto the conveying member, and decreasing the predetermined contact force of the conveying member to the plurality of image carriers before respective tips of the toner images on the conveying member pass subsequent contacting portions of the contacting portions between the plurality of image carriers and the conveying member, so that respective parts of the toner images on the conveying member are not transferred back onto subsequent image carriers of the plurality of image carriers.

Further, the method of forming, further includes, detecting image densities of the toner images on the conveying member, and setting an image forming condition on a basis of the detected image densities.

Further, the detecting of image densities includes detecting the image densities of the toner images on the conveying member before and after decreasing the predetermined contact force, and the setting of image forming condition sets the image forming condition on a basis of the image densities detected before and after decreasing the predetermined contact force.

Further, the transferring of toner images transfers the toner images by applying transferring biases between the conveying member and the plurality of image carriers, and the setting of image forming condition sets respective electric potential strengths of the transferring biases.

Further, the forming of toner images includes making developer adhere to the plurality of image carriers by applying developing biases between plurality of developing devices and the plurality of image carriers, and the setting of image forming condition sets respective electric potential strengths of the developing biases between the plurality of developing devices and the plurality of image carriers.

Further, the forming of toner images includes making developer adhere to the plurality of image carriers by applying developing biases between plurality of developing devices and the plurality of image carriers, and the setting of image forming condition sets respective toner amounts supplied from plurality of toner containers to the plurality of developing devices.

According to a preferred embodiment of the present invention, a method of forming an image with an image forming apparatus of a tandem method including an intermediate transfer member to intermediately carry toner images to be transferred onto the recording member, arranged to oppose a conveyed recording member and to rotate in a sub-scanning direction, and a plurality of image carriers to contact the intermediate transfer member with an equal interval between contacting portions of the plurality of image carrier and the intermediate transfer member, the method includes, forming toner images of a predetermined pattern on the plurality of image carriers respectively, a length of the pattern in the sub-scanning direction being set shorter than a length of the equal interval between the contacting portions of the intermediate transfer member and the plurality of image carriers, transferring the toner images onto the intermediate transfer member, and decreasing the predetermined contact force of the intermediate transfer member to the plurality of image carriers before respective tips of the toner images on the intermediate transfer member pass subsequent contacting portions of the contacting portions between the plurality of image carriers and the intermediate transfer member, so that respective parts of the toner images on the intermediate transfer member are not transferred back onto subsequent image carriers of the plurality of image carriers.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein:

FIG. 4 is a view illustrating a transferring bias table;

FIG. 5 is a view illustrating a developing bias table;

DETAILED DESCRIPTION OF THE PREFERRED EMBODIMENTS

Figure 1:
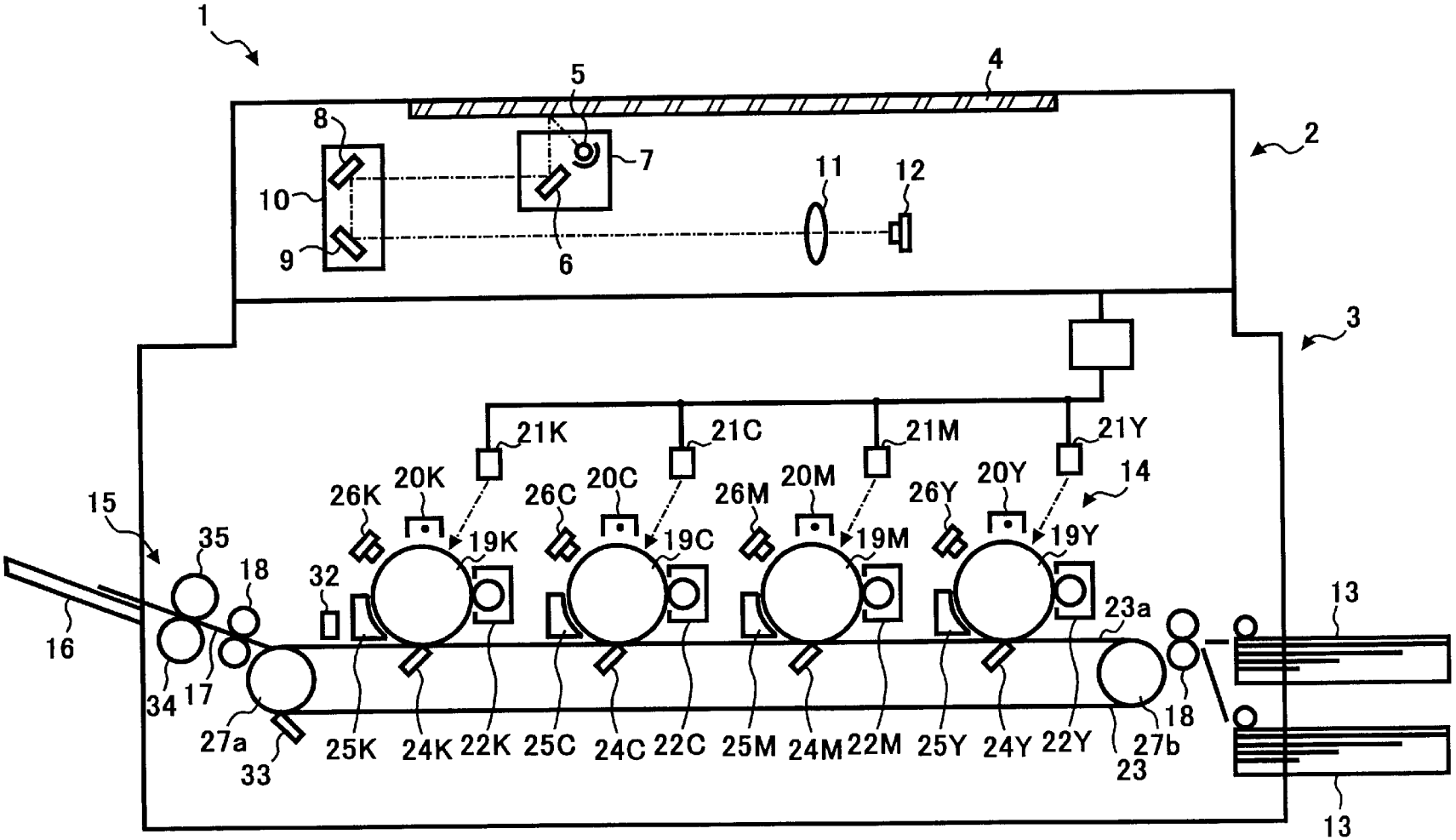
FIG. 1 is a longitudinal sectional view illustrating a color copying machine of a first embodiment of the present invention.

Referring now to the drawings, wherein like reference numerals designate identical or corresponding parts throughout the several views, preferred embodiments of the present invention are described.

Referring to FIGS. 1–6, a preferred embodiment of the present invention will be now described. In this embodiment, the present invention is applied to a color copying machine of a tandem method as an example of an image forming apparatus.

FIG. 1 is a longitudinal sectional view illustrating a color copying machine. The color copying machine 1 includes an image reading unit 2 arranged in an upper portion and an image forming unit 3 arranged in a lower portion thereof.

The image reading unit 2 is provided with a contact glass 4, on which a document is put. At the lower side of the contact glass 4, a first moving device 7 mounting an illumination lamp 5 and a mirror 6 and a second moving device 10 mounting mirrors 8 and 9 are installed so as to move at a speed ratio of two to one in a sub scanning direction by a motor (not illustrated). On the optical path reflected from the mirror 9, a color CCD 12 is arranged by way of a focusing lens 11.

In the image forming unit 3, a paper guiding path 17 is formed from a paper feeding tray 13 holding stacked sheets of paper, by way of an image forming portion 14 of an electrophotographic process and a fixing portion 15 to a paper ejecting tray 16 to which the sheets after image formation thereon are ejected. On the paper guiding path 17, plural pairs of conveying rollers 18, which convey the sheet on the paper guiding path 17 in a predetermined direction, are installed.

In the image forming portion 14, photoconductive members 19Y, 19M, 19C, and 19K functioning as image carriers are installed for respective colors of Y (yellow), M (magenta), C (cyan), and K (black). The photoconductive members 19Y, 19M, 19C, and 19K are arranged at the positions where respective lower end portions thereof interfere with the paper guiding path 17. Around the respective photoconductive members 19Y, 19M, 19C, and 19K, charging devices 20Y, 20M, 20C, and 20K which uniformly charge the surfaces of the corresponding photoconductive members 19Y, 19M, 19C, and 19K, exposing devices 21Y, 21M, 21C, and 21K which expose predetermined patterns on the surfaces of the corresponding photoconductive members 19Y, 19M, 19C, and 19K, developing devices 22Y, 22M, 22C, and 22K which hold developers containing toners of predetermined colors and apply developing biases between the corresponding photoconductive members 19Y, 19M, 19C, and 19K and the developing devices, transferring devices 24Y, 24M, 24C, and 24K which are arranged in a rear surface side of a conveying surface 23*a* of a conveying transfer belt 23 described later and which apply transferring biases between the corresponding photoconductive members 19Y, 19M, 19C, and 19K and the transferring devices, cleaners 25Y, 25M, 25C, and 25K which remove the residual toners on the surfaces of the respective photoconductive members 19Y, 19M, 19C, and 19K after the toner images have been transferred, and discharging devices 26Y, 26M, 26C, and 26K which remove the charges on the surfaces of the respective photoconductive members 19Y, 19M, 19C, and 19K, are arranged, respectively.

The developing devices 22Y, 22M, 22C, and 22K have developing rollers y, m, c, and k for making the held developers adhere to the photoconductive members 19Y, 19M, 19C, and 19K respectively. When the toners adhere to the photoconductive members 19Y, 19M, 19C, and 19K by the developing devices 22Y, 22M, 22C, and 22K, the developing biases are applied between the photoconductive members 19Y, 19M, 19C, and 19K, and the developing rollers y, m, c, and k.

Further, in the image forming portion 14, a conveying transfer belt 23, which is wound around a driving roller 27*a* and a driven roller 27*b*, is installed. In the conveying transfer belt 23, the surface thereof facing the photoconductive members 19Y, 19M, 19C, and 19K is a conveying surface 23*a*. The conveying surface 23*a* of the conveying transfer belt 23 moves toward the downstream side in the sheet conveying direction as the driving roller 27*a* rotates in a predetermined direction, and thereby the conveying transfer belt 23 functions as a conveying member that conveys the sheet in a predetermined direction.

Usually, the conveying surface 23*a* contacts each of the photoconductive members 19Y, 19M, 19C, and 19K with a predetermined contact force by a tension adjusting member 28 (see FIG. 2) as a contact force adjusting mechanism.

Figure 2:
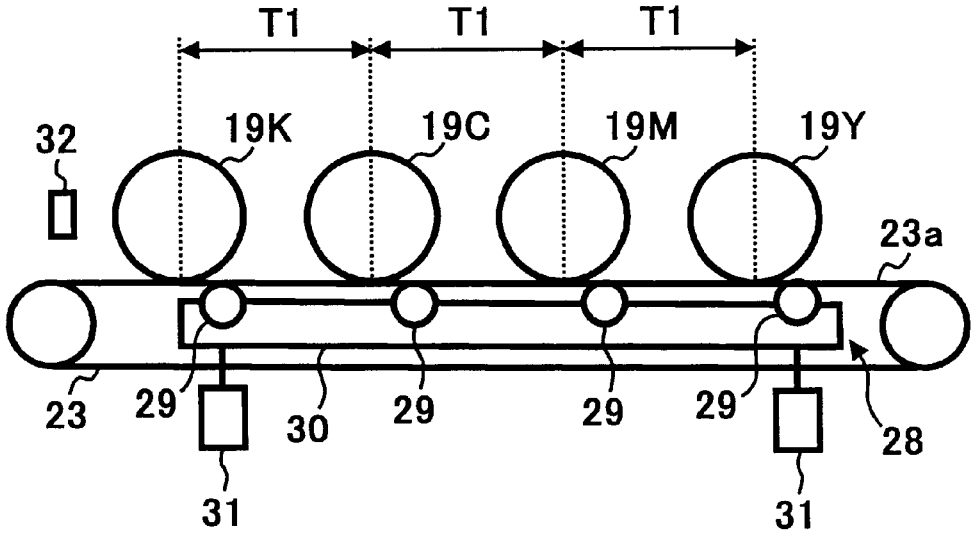
FIG. 2 is a side view illustrating a tension adjusting member.

FIG. 2 is a side view illustrating the tension adjusting member 28. The tension adjusting member 28 is installed in the rear surface side of the conveying surface 23*a* of the conveying transfer belt 23. The tension adjusting member 28 includes tension rollers 29 which make the conveying surface 23*a* contact the photoconductive members 19Y, 19M, 19C, and 19K, a tension roller supporting member 30 which supports those tension rollers 29 movably in a vertical direction, and solenoids 31 which, when turned on or off, move the tension roller supporting member 30 to predetermined positions in the vertical direction.

In this embodiment, when the conveying surface 23*a* of the conveying transfer belt 23 contacts the photoconductive members 19Y, 19M, 19C, and 19K by the tension adjusting member 28, the photoconductive members 19Y, 19M, 19C, and 19K are arranged, such that respective interval lengths T1 between the contacting portions where the photoconductive members 19Y, 19M, 19C, and 19K respectively contact the conveying transfer belt 23, are equal.

Moreover, in the image forming portion 14, a density sensor 32 as an image density detecting device which detects the image densities of toner images transferred on the conveying transfer belt 23 when toner forming conditions described later are set, is installed at the downstream side of the photoconductive member 19K in the sheet conveying direction.

Furthermore, in the image forming portion 14, a cleaner 33, which removes the toner images transferred on the conveying transfer belt 23 when the image forming conditions described later are set, is installed at the downstream side of the density sensor 32 in the sheet conveying direction.

The fixing portion 15 has a heating roller 34 and a pressing roller 35. In the fixing portion 15, when a sheet on which the toner images are transferred passes the contacting portion of the heating roller and the pressing roller, the toner images are fixed by being heated and pressed onto the sheet.

Figure 10:
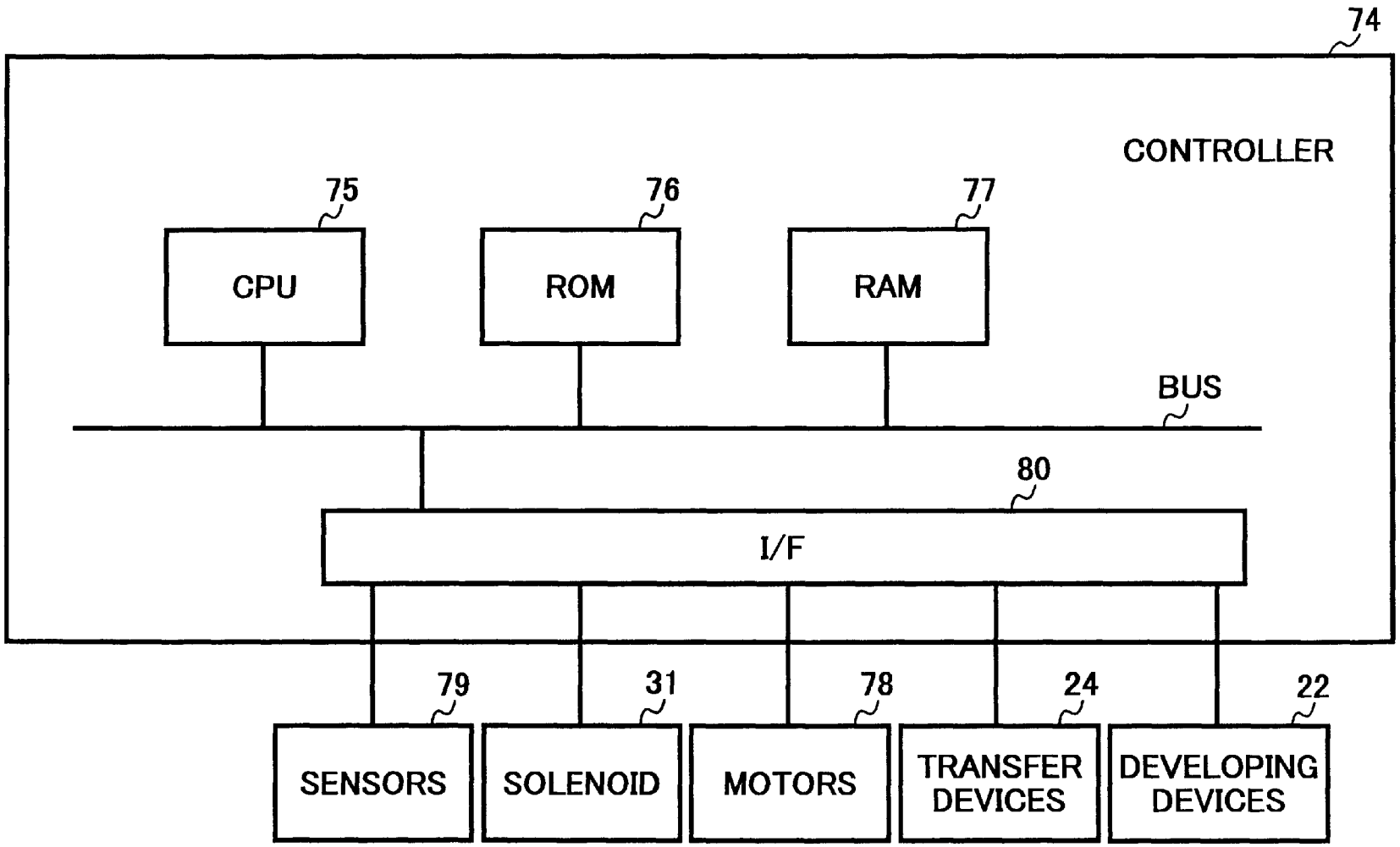
FIG. 10 is a block diagram illustrating a controller.

The color copying machine 1 includes a controller 74 which drives and controls each device in the color copying machine 1, as illustrated in FIG. 10. The controller includes a CPU 75 which centrally drives and controls each device, a ROM 76 which previously stores fixed data such as a controlling program, a RAM 77 which rewritably stores variable data, and so on, which are connected by bus lines.

In the ROM 76, a density detecting pattern 36 (see FIG. 3), a correcting value table 37 (see FIG. 4), and an image forming condition table 38 (see FIG. 5) etc. are stored.

Figure 3:
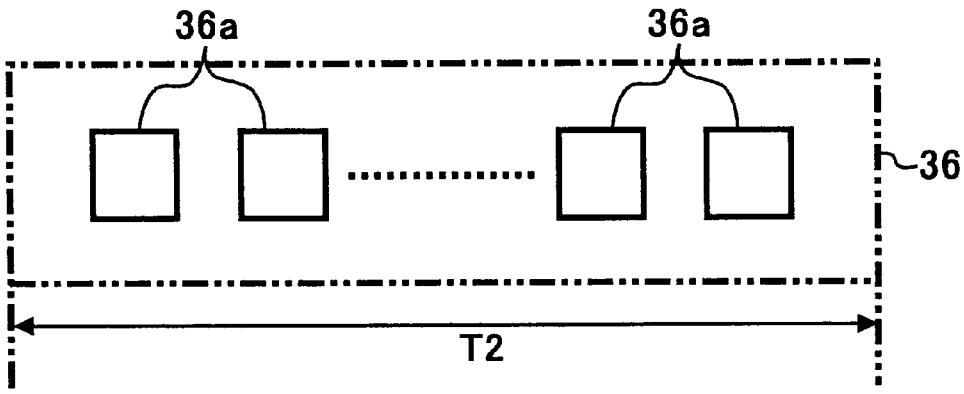
FIG. 3 is a plan view illustrating a density detecting pattern.

FIG. 3 is an explanation view illustrating the density detecting pattern 36. The density detecting pattern 36 as a predetermined pattern is a basic pattern which is used for detecting the image density of the toner image transferred on the conveying transfer belt 23 when the image forming conditions are set as described later. The density detecting pattern 36 includes nine squares 36*a* 10 mm wide in main and sub-scanning directions, which are arranged at an interval of 10 mm in the sub scanning direction. A predetermined margin width is formed at both end portions in the sub-scanning direction. The total length T2 of the density detecting pattern 36 in the sub-scanning direction is set shorter than the interval length T1 between the contacting portions where the photoconductive members 19Y, 19M, 19C, and 19K respectively contact the conveying transfer belt 23. In this embodiment, the total length T2 of the density detecting pattern 36 in the sub-scanning direction is 200 mm.

FIG. 4 is an explanation view illustrating the correcting value table 37. In the correcting value table 37, the correcting values 37*b* for the transferring bias set in advance are stored, corresponding to the values 37*a* on the basis of the ratio of the image densities of the toner images transferred on the conveying transfer belt 23, which are obtained for different two levels of the contact force between the respective photoconductive members 19Y, 19M, 19C, and 19K and the conveying transfer belt 23. The correcting value table 37 is used when the image forming conditions described later are set.

FIG. 5 is an explanation view illustrating the image forming condition table 38. In the image forming condition table 38, charging electric potentials Vd of the photoconductive members 19Y, 19M, 19C, and 19K, and developing biases Vb applied by the developing devices 22Y, 22M, 22C, and 22K are stored for each pair 38*a* of the charging electric potential and the developing bias. The image forming condition table 38 is used when the density detecting pattern 36 is formed on the conveying transfer belt 23 for setting the image forming conditions described later.

Several kinds of motors 78, which rotate the photoconductive members 19Y, 19M, 19C, and 19K, or the driving roller 27*a* etc., and several kinds of sensors 79 etc. are connected to the controller by way of an I/F circuit 80. Thereby, the photoconductive members 19Y, 19M, 19C, and 19K, and the conveying transfer belt 23 etc., are rotated in a predetermined direction.

Further, the developing devices 22Y, 22M, 22C, and 22K, and the transferring devices 24Y, 24M, 24C, and 24K are connected to the controller 74 by way of the I/F circuit 80, and thereby the developing biases which are applied when forming the toner images, and the transferring biases which are applied when transferring the toner images etc., are controlled.

Moreover, the solenoids 31 of the tension adjusting member 28 are connected to the controller 74 by way of the I/F circuit 80, and the controller 74 drives and controls ON/OFF of the solenoids 31. When the solenoids 31 are OFF, the tension adjusting member 28 positions the tension roller supporting member 30 at an upper side, such that the conveying surface 23*a* and the photoconductive members 19Y, 19M, 19C, and 19K are contacted with each other by a predetermined contact force. On the other hand, when the solenoids are ON, the tension adjusting member 28 positions the tension roller supporting member 30 at a lower side, such that the tension rollers 29 are lowered, and the conveying surface 23*a* and the photoconductive members 19Y, 19M, 19C, and 19K are made apart, and thereby the contact force of the conveying surface 23*a* to the photoconductive members 19Y, 19M, 19C, and 19K is released. In this embodiment, the contacting force between the conveying surface 23*a* of the conveying belt 23 and the photoconductive members 19Y, 19M, 19C, and 19K is adjusted at two levels by ON/OFF of the solenoids 31.

Next, the copying operation of a document image in the color copying machine 1 described above will be described. At first, the first and the second moving devices 7 and 10 are moved with an illuminating lamp 5 turned on, so that the document image on the contact glass 4 is exposed and scanned. The returning light from the document is reflected by the mirrors 6, 8, and 9, and is focused to the color CCD 12 by the focusing lens 11.

The color CCD 12 performs photoelectric transducing on the returning light from the document, and generates multi level electric signals separated into colors of R (Red), G (Green), and B (Blue). The multi level electric signal of each color of RGB is converted into gradation data of 128 levels of 8 bits in each of Y (yellow), M (magenta), C (cyan), and K (black).

The gradation data of 128 levels of 8 bits converted to each of YMCK is output to the exposing devices 21Y, 21M, 21C, and 21K corresponding to respective colors.

The exposing devices 21Y, 21M, 21C, and 21K form predetermined electrostatic latent images on the photoconductive members 19Y, 19M, 19C, and 19K by exposing and scanning on the surfaces of the photoconductive members 19Y, 19M, 19C, and 19K respectively according to the gradation data. When exposing and scanning in an ordinary operation, the timings of the exposing and the scanning to the respective photoconductive members 19Y, 19M, 19C, and 19K are shifted respectively so that the tip of the sheet conveyed on the paper conveying path 17 conforms to the tips of the electrostatic latent images on the respective photoconductive members 19Y, 19M, 19C, and 19K at the respective transferring positions.

By applying the developing biases by the developing devices 22Y, 22M, 22C, and 22K, the toners adhere to the electrostatic latent images and the toner images of the predetermined colors are formed. The toner images formed on respective photoconductive members 19Y, 19M, 19C, and 19K are superposed one upon another and transferred onto a sheet, by applying the transferring biases by the transferring devices 24Y, 24M, 24C, and 24K, when the sheet conveyed from the paper feeding tray 13 is positioned at the transferring positions by adjusting the timing. Because the timings of the exposing and the scanning to the respective photoconductive members 19Y, 19M, 19C, and 19K are shifted respectively, the images of the respective colors can be superposed on the sheet without adjusting respectively as conforming the timing of the conveying of the sheet to the respective photoconductive members 19Y, 19M, 19C, and 19K.

The sheet is heated and pressed by the fixing portion 15 when the sheet passes the fixing portion 15, and the toner image is fixed onto the sheet. Thereby, a predetermined color image is formed on the sheet.

Next, the setting operation of the image forming conditions in the image forming operation described above will be described. The setting operation of the image forming conditions is performed separated from a predetermined image forming operation, when the conditions which are set in advance, such as a predetermined key operation, or passage of a predetermined time, are satisfied. In this embodiment, the transferring biases applied by the transferring devices 24, the developing biases applied by the developing devices 22, or the charging electric potentials Vd of the photoconductive members 19Y, 19M, 19C, and 19K etc., are set as the image forming condition for each color of YMCK.

The setting operation of the transferring biases in the image forming conditions will be described. At first, the photoconductive members 19Y, 19M, 19C, and 19K and the driving roller 27*a* are rotated by driving the motor. The conveying transfer belt 23 is rotated so that the conveying surface 23*a* thereof moves to the downstream side in the sheet conveying direction, by rotation of the driving roller 27*a*.

When the photoconductive members 19Y, 19M, 19C, and 19K are rotated, the charging devices 20Y, 20M, 20C and 20K are driven, so that the surfaces of the photoconductive members 19Y, 19M, 19C, and 19K are uniformly charged. In this embodiment, the image forming condition "6" in the forming condition table 38 is used, and at this time, the charging electric potentials of the photoconductive members 19Y, 19M, 19C, and 19K are set to −700 V.

Then, the charged surfaces of the photoconductive members 19Y, 19M, 19C, and 19K are exposed and scanned respectively by the corresponding exposing devices 21Y, 21M, 21C, and 21K, on the basis of the density detecting pattern 36 which is obtained by referring to the ROM. Thereby, the electrostatic latent images of the density detecting pattern 36 are uniformly formed on the surfaces of the photoconductive members 19Y, 19M, 19C, and 19K, respectively. When the setting operation of the image forming conditions, the exposing and the scanning to the respective photoconductive members 19Y, 19M, 19C, and 19K is performed at the same timing. Thereby, the density detecting pattern 36 of each color is formed respectively and independently on the conveying transfer belt 23 without depending on the timings of the exposing and the scanning of the density detecting patterns 36 of the other colors.

Thereafter, toners are to adhere to the electrostatic latent images by driving the developing devices 22Y, 22M, 22C, and 22K. Thereby, the toner images of the density detecting pattern 36 are formed on the surfaces of the photoconductive members 19Y, 19M, 19C, and 19K. As a result, the function as the toner image forming device is achieved. In this embodiment, because the image forming condition "6" in the image forming condition table 38 is used, the developing biases applied between the photoconductive members 19Y, 19M, 19C, and 19K and the developing devices 22Y, 22M, 22C, and 22K are set to −500 V.

In addition, when the photoconductive members 19Y, 19M, 19C, and 19K rotate such that the tip portions of the density detecting patterns 36, to which the toners have adhered on the photoconductive members 19Y, 19M, 19C, and 19K, face the transferring devices 24Y, 24M, 24C, and 24K, by way of the conveying surface 23*a* of the conveying transfer belt 23, the predetermined transferring biases are applied between the photoconductive members 19Y, 19M, 19C, and 19K and the transferring devices 24Y, 24M, 24C, and 24K by the transferring devices 24Y, 24M, 24C, and 24K. Thereby, the toner images of the density detecting pattern 36 are transferred onto the conveying transfer belt 23. As a result, the function as the transferring device is achieved.

The operation of each device described above, from the start of rotation of the photoconductive members 19Y, 19M, 19C, and 19K until the transfer of toner images onto the conveying transfer belt 23 by the transferring devices 24Y, 24M, 24C, and 24K, is continuously performed.

When the conveying surface 23*a* of the conveying transfer belt 23 moves from the position where the transferring biases has started to be applied, to the downstream side in the sheet conveying direction by the total length T2 of the density detecting pattern 36 in the sub scanning direction, the transferring biases by the transferring devices 24Y, 24M, 24C, and 24K stopped being applied, and the solenoids 31 of the tension adjusting member 28 are turned ON. Thereby, the tension roller supporting member 30 and the tension rollers 29 are moved to the lower side, so that the contact force between the conveying transfer belt 23 and the photoconductive members 19Y, 19M, 19C, and 19K is decreased. As a result, a part of the function as the contact force changing device is achieved by the controller 74. The conveying transfer belt 23 continues to rotate with the contact force to the photoconductive members 19Y, 19M, 19C, and 19K decreased.

The state that "the contact force is decreased" means that the conveying transfer belt 23 is positioned with respect to the photoconductive members 19Y, 19M, 19C, and 19K, so that the reverse transfer such that a part of each of the toner images transferred on the conveying transfer belt 23 is transferred onto the photoconductive members 19Y, 19M, 19C, and 19K again, does not occur. When the contact force is decreased, the conveying transfer belt 23 may contact the photoconductive members 19Y, 19M, 19C, and 19K, or may be separate from the photoconductive members 19Y, 19M, 19C, and 19K. The conveying belt is not limited to being in only one of the two states of contacting and being separate. Further, at the same time when the transferring biases by the transferring devices 24Y, 24M, 24C, and 24K stop being applied, the rotation of the developing rollers y, m, c, and k arranged in the developing devices 22Y, 22M, 22C, and 22K is stopped. When the developing rollers y, m, c, and k stop rotating, the rotation of the developing rollers y, m, c, and k may be stopped by stopping the driving of motors which drive the developing rollers y, m, c, and k, or by releasing clutches when the developing rollers y, m, c, and k rotate by way of the clutches etc.

When the developing rollers y, m, c, and k continue to rotate, it is feared that the toners adhere to the positions to which the toners should not adhere. In this embodiment, because the rotation of the developing rollers y, m, c, and k is stopped, it can be prevented that the toners adhere to the surfaces of the photoconductive members 19Y, 19M, 19C, and 19K additionally. In addition, the residual toners on the surfaces of the photoconductive members 19Y, 19M, 19C, and 19K which are not transferred onto the conveying transfer belt 23, are removed by the cleaners 25. Thereby, it can be prevented that the toner patterns on the conveying transfer belt 23 are made dirty by transferring the unnecessary toners onto the conveying transfer belt 23.

In this embodiment, the total length T2 of the density detecting pattern 36 in the sub scanning direction is set shorter than the interval length T1 between the contacting portions where the photoconductive members 19Y, 19M, 19C, and 19K contact the conveying transfer belt 23, and therefore the density detecting patterns of different colors are not overlapped on the conveying transfer belt 23 when the transferring biases by the transferring devices 24Y, 24M, 24C, and 24K are applied. Thereby, the toner images formed on the photoconductive members 19Y, 19M, 19C, and 19K are transferred at the same time, so that the density detecting patterns 36 on the respective photoconductive members 19Y, 19M, 19C, and 19K can be formed at the same time on the conveying transfer belt 23.

When the conveying transfer belt 23 rotates at the positions where the toner images of respective colors formed on the conveying transfer belt 23 respectively face the density sensor 32, the density sensor 32 detects the image densities of the toner images in sequence, and the detection results P1 are stored in a temporary storing area in the RAM 77 in the controller 74. After the toner images have been transferred from the photoconductive members 19Y, 19M, 19C, and 19K onto the conveying transfer belt 23, the contact force between the conveying transfer belt 23 and the photoconductive members 19Y, 19M, 19C, and 19K is released. Therefore, the image densities of the toner images, in which the reverse transfer of the toner has been suppressed, are detected by the one density sensor 32.

After the detection of the image densities of the toner images, the toner images of the density detecting patterns 36 formed on the conveying transfer belt 23 are removed by the cleaner 33.

Further, the residual toners on the photoconductive members 19Y, 19M, 19C, and 19K after the contact force with the conveying transfer belt 23 has been released, are removed by the cleaners 25Y, 25M, 25C, and 25K, and further the residual charges thereon are discharged by the discharging devices 26Y, 26M, 26C, and 26K, and the surfaces of the photoconductive members 19Y, 19M, 19C, and 19K are uniformly charged again by the charging devices 20Y, 20M, 20C, and 20K.

Therefore, the toner images of the density detecting pattern 36 are formed on the surfaces of the photoconductive members 19Y, 19M, 19C, and 19K, and are transferred onto the conveying transfer belt 23 in a similar manner as described above. As a result, the functions as the toner image forming device and the transferring device are achieved.

When the conveying surface 23*a* of the conveying transfer belt 23 moves by the total length T2 of the density detecting patterns 36 in the sub scanning direction from the position where the transferring biases start being applied, the transferring biases by the transferring devices 24Y, 24M, 24C, and 24K stop being applied. At this time, the solenoids 31 of the tension adjusting member 28 remain to be OFF. As a result, a part of the function as the contact force changing device is achieved. Thereby, the positions of the tension roller supporting member 30 and the tension rollers 29 remain at the upper side and the conveying transfer belt 23 remains in the state that the conveying surface 23*a* contacts the photoconductive members 19Y, 19M, 19C, and 19K.

Further, at this time, the application of the transferring biases is also stopped and further the rotation of the developing rollers y, m, c, and k is also stopped in a similar manner as described above. Thereby, even when the rotation continues in the state that the conveying surface 23*a* of the conveying transfer belt 23 contacts the photoconductive members 19Y, 19M, 19C, and 19K, it can be prevented that the toner patterns on the conveying transfer belt 23 are made dirty by transferring the residual toners onto the conveying transfer belt 23.

Because the conveying transfer belt 23 continues to rotate in the state that the conveying surface 23*a* contacts the photoconductive members 19Y, 19M, 19C, and 19K, the toner images other than the toner image transferred from the photoconductive member 19K which is at the most downstream side in the sheet conveying direction, pass the contacting portions between the conveying transfer belt 23 and the photoconductive members 19M, 19C, and 19K which are different from the respective photoconductive members 19Y, 19M, and 19C from which the respective toner images are transferred. When passing, the reverse transfer occurs such that the toners transferred on the conveying transfer belt 23 adhere to the photoconductive members 19Y, 19M, 19C, and 19K.

The density sensor 32 detects the image densities of the toner images of the density detecting patterns 36 of the respective colors on the conveying transfer belt 23, in which the reverse transfer has occurred, in a similar manner as described above. The detection results P2 are stored in a temporary storing area in the RAM.

In this embodiment, the two levels such that the conveying transfer belt 23 contacts the photoconductive members 19Y, 19M, 19C, and 19K and that the conveying transfer belt 23 is separate from the photoconductive members 19Y, 19M, 19C, and 19K are set as the respective levels such that the contact force of the conveying transfer belt 23 to the photoconductive members 19Y, 19M, 19C, and 19K is made different plural levels, and the detection results P1 and P2 are obtained as the plural image densities at the respective levels.

After the detection of the image densities, the toner images of the density detecting pattern on the conveying transfer belt 23 are removed by the cleaner 33.

Next, P2/P1 is calculated on the basis of the detection results P1 and P2. When the calculated P2/P1 is P, a correcting value corresponding to the calculated value P is obtained by referring to the correcting value table 37.

The obtained correcting value is added to an ordinary transferring bias which is set in advance, and the total amount value of the transferring bias is set to the transferring bias in subsequent image forming operations. As a result, the function as the image forming condition setting device is achieved by the controller 74. In the subsequent image forming operations, the transferring bias thus set by the transferring device is applied. The set transferring bias is held until the next image forming conditions are set.

The calculated value P for obtaining the correcting value has been calculated on the basis of the image densities of the toner images on the conveying transfer belt 23 in the state that the conveying transfer belt 23 contacts the photoconductive members 19Y, 19M, 19C, and 19K and in the state that the contact force between the conveying transfer belt 23 and the photoconductive members 19Y, 19M, 19C, and 19K is released. Because the correcting values of the transferring bias such that the reverse transfer can be suppressed according to the value of P are set in the correcting value table 37, the reverse transfer can be prevented and the high quality image forming can be achieved by using the transferring bias corrected by the correcting values. Because the correcting values are different in an each type of apparatus, optimum values are previously sought by experiments etc., and are stored in the ROM.

Next, the setting operation of the developing bias in the image forming conditions will be described. When setting the developing bias, the each pattern in the density detecting pattern 36 is formed changing the developing bias according to the image forming condition table 38 illustrated in FIG. 5 in a similar manner as when P1 is sought as described above, and the density, namely the toner adhering amount of the each pattern is detected.

Figure 6:
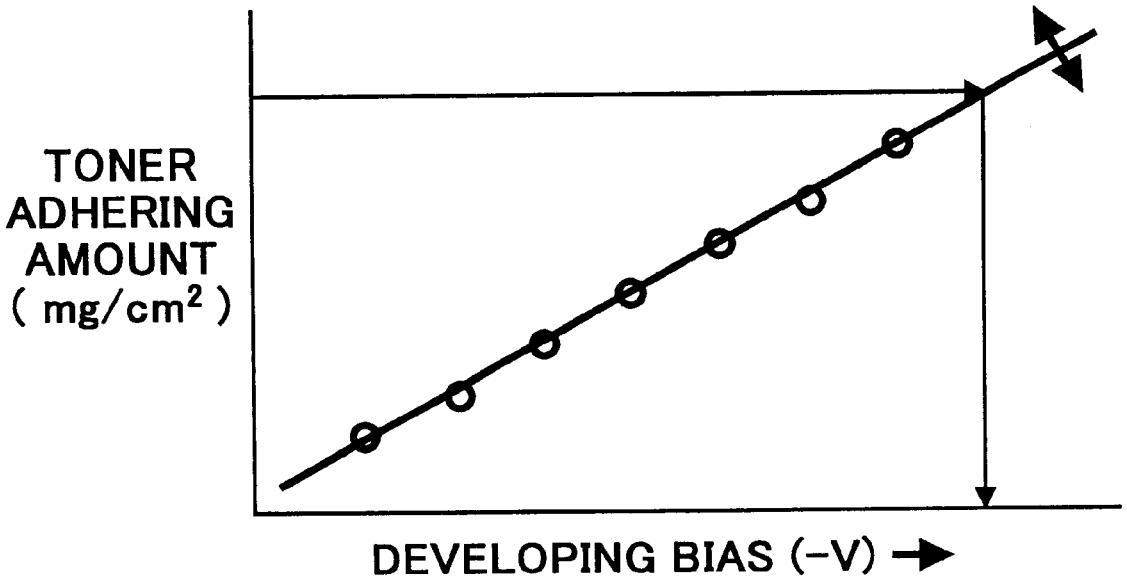
FIG. 6 is a correlation view illustrating relationship between a toner adhering amount and developing bias.

Next, from the detected toner amount and the applied developing bias, the relationship formula between the both is calculated. As shown in FIG. 6, because the toner adhering amount by an unit area is almost proportion to the developing bias, the relationship can be approximate to a straight line. Then, the developing bias which is necessary for obtaining the toner adhering amount of the target when forming the image which is set in advance, is sought from the calculated formula, and the toner adhering amount of the target can be obtained by using this developing bias when forming the image.

In this embodiment, the relationship formula between the toner adhering amount and the developing bias is obtained for every setting operation of the image forming conditions. However, the relationship between the toner adhering amount and the developing bias can be obtained for every predetermined number of times of the setting operation of the image forming conditions. When the relationship between the toner adhering amount and the developing bias is renewed for every predetermined number of times on the setting operation of the image forming conditions, the processing time for setting the developing bias can be short by securing a storing area in the RAM etc. in advance.

Moreover, the relationship between the charging electric potential and the developing bias can be obtained in advance by experiments etc., and thereby the charging electric potentials of the photoconductive members 19Y, 19M, 19C, and 19K can be also obtained according to the developing biases set as described above.

Because the image forming conditions are set on the basis of the image densities of toner images formed on the conveying transfer belt 23, when the image forming operation is performed under those image forming conditions, the image forming conditions may not be optimum for the sheet on which an image is actually formed. With respect to this point, the difference between the image densities of toner images formed under the same image forming conditions on the sheet and on the conveying transfer belt 23, can be obtained in advance, for example by experiments etc., and thereby the image forming conditions corresponding to the sheet can be set according to the image densities of the toner images formed on the conveying transfer belt 23.

Next, referring to FIGS. 7–9, a second embodiment of the present invention will be described. The present invention is applied to a color copying machine of a tandem method having a two components developing device. The same portions as those in the first embodiment are designated by the same numerals, and the description thereof will be omitted.

Figure 7:
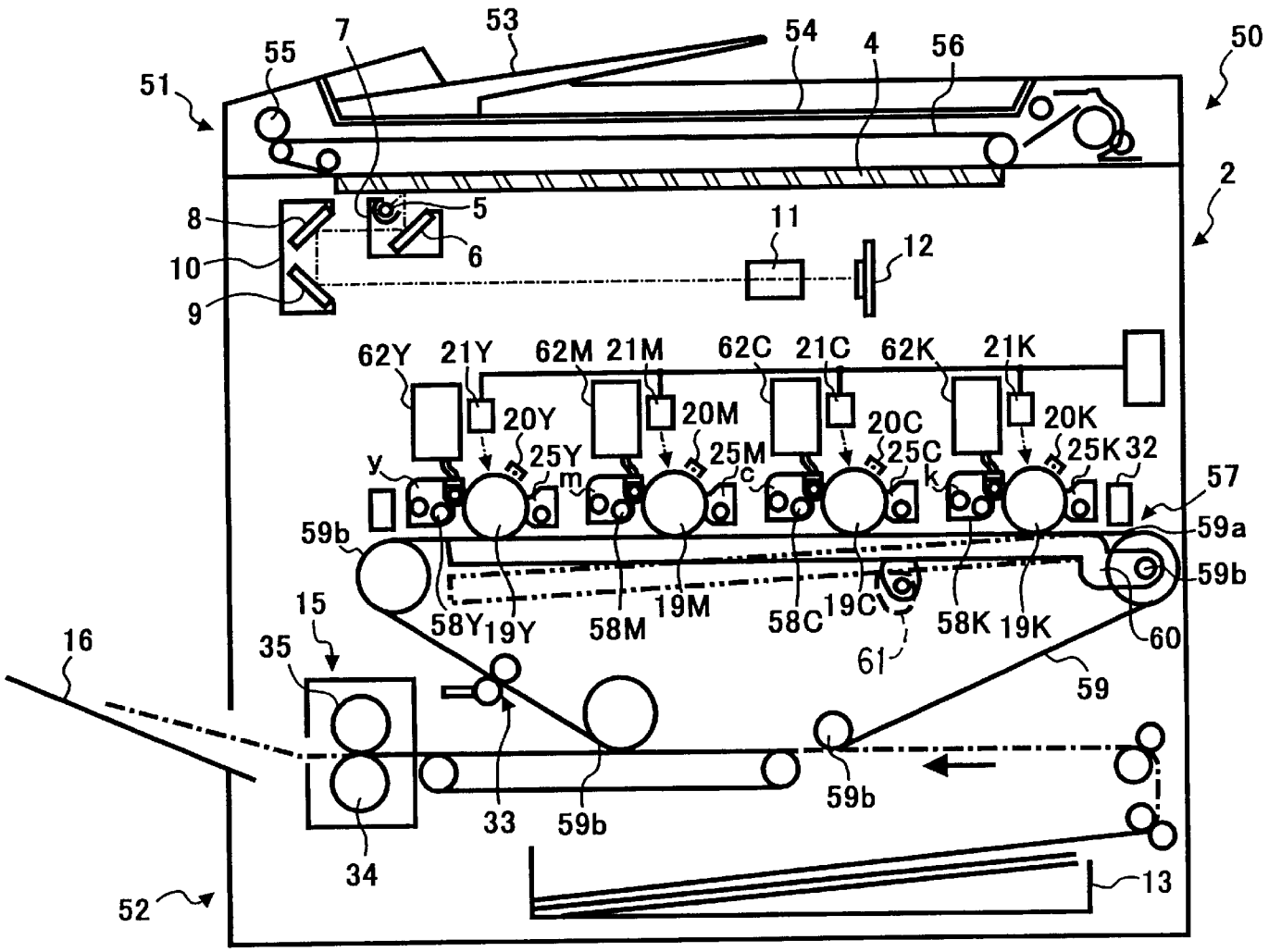
FIG. 7 is a longitudinal sectional view illustrating a color copying machine of a second embodiment of the present invention.

FIG. 7 is a longitudinal sectional view illustrating the color copying machine of the second embodiment of the present invention. The color copying machine 50 includes an image reading unit 2, an ADF (Auto Document Feeder) 51 arranged at the upper side of the image reading unit 2, and an image forming unit 52 arranged at the lower side thereof.

Although the detailed description will be omitted because of a known technique, the ADF 51 carries out documents stacked on a document stacking table 53 to a contact glass 4. The ADF has a document conveying roller 55 and a document conveying belt 56 etc. which eject documents whose images has been read to a document ejecting table 54.

Around the photoconductive members 19Y, 19M, 19C, and 19K arranged in an image forming portion 57 of the image forming unit 52, charging devices 20Y, 20M, 20C, and 20K, exposing devices 21Y, 21M, 21C, and 21K, two components developing devices 58Y, 58M, 58C, and 58K, transferring devices (not illustrated), cleaners 25Y, 25M, 25C, and 25K, and discharging devices (not illustrated), are arranged, respectively.

In the image forming portion 57, an intermediate transfer belt 59 as an intermediate transfer member, which is wound around plural rollers 59*b,* is installed. A transferring surface 59*a* of the intermediate transfer belt 59 (an outer circumference surface of the intermediate transfer belt 59) is pressed by a pressing member 60, so as to contact the photoconductive members 19Y, 19M, 19C, and 19K. The pressing member 60 is configured so as to contact or separate from the intermediate transfer belt 59 by switching a cam 61. By the pressing member 60 and the cam 61, a contact force adjusting mechanism is realized. When the pressing member 60 is apart from the intermediate transfer belt 59 by switching the cam 61, the contact force between the transferring surface 59*a* and the respective photoconductive members 19Y, 19M, 19C, and 19K is decreased so that the reverse transfer of toner does not occur.

Although the description will be omitted because of a known technique, developers in which "two components" of a toner and a carrier are mixed, are held in the two components developing devices 58Y, 58M, 58C, and 58K. Although not illustrated in FIG. 7, magnetic permeability detecting devices which detect the change of mixture ratio of the toner and the carrier, are arranged in the two components developing devices 58Y, 58M, 58C, and 58K, respectively.

Toner supplying apparatuses 62Y, 62M, 62C, and 62K which supply toners to the two components developing devices 58Y, 58M, 58C, and 58K are connected to the respective two components developing devices 58Y, 58M, 58C, and 58K by way of a toner conveying tube 66. Because all the toner supplying apparatuses 62Y, 62M, 62C, and 62K have the same structure, they all will be described as a toner supplying apparatus 62.

Figure 8:
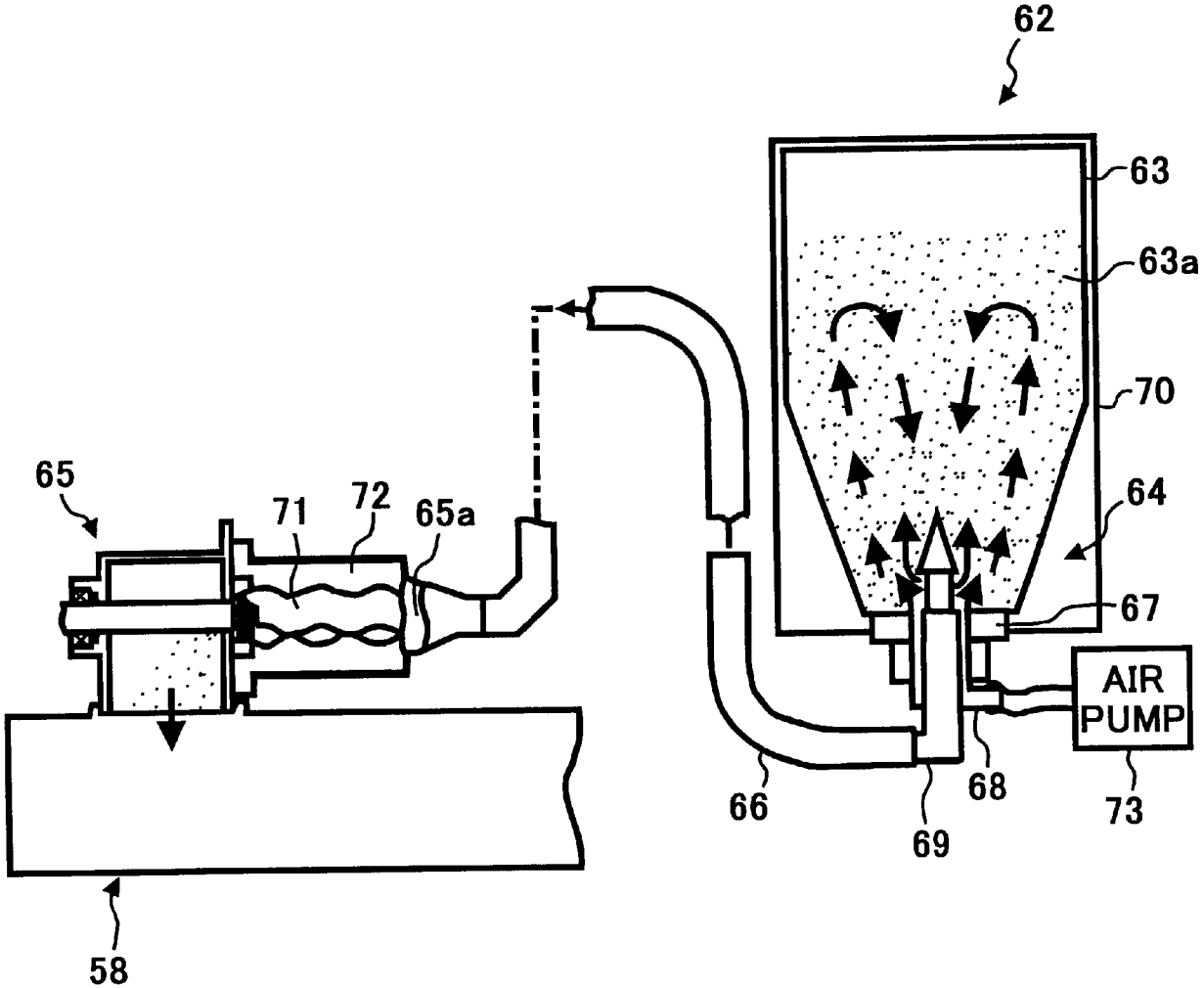
FIG. 8 is a longitudinal sectional view illustrating a toner supplying apparatus.

FIG. 8 is a longitudinal sectional view illustrating the toner supplying apparatus 62. The toner supplying apparatus 62 includes a toner storing container 63, a structure 64 to exhaust the toner from the toner storing container 63, a powder pump 65 of the corresponding two components developing device 58, and a toner tube 66 which connects the powder pump 65 to the toner storing container 63 and so on.

The toner storing container 63 is a container for storing a supplying toner 63*a,* and is formed so that the width thereof is narrower toward a lower portion thereof. The toner storing container 63 has a sealed structure, and a seal valve 67 which is made of elastic material such as a foaming sponge is arranged at the bottom surface thereof. An air nozzle 68 is inserted into an inner circumference surface side of the seal valve 67. One end of the air nozzle 68 is inserted into an inside of the toner storing container 63, and the other end thereof is connected to an air pump 73.

A nozzle 69 is inserted into the inside of the toner storing container 63 by way of the air nozzle 68 inside the seal valve 67. When changing the toner, the toner storing container 63 including the seal valve 67 is detached from the color copying machine 50 as a toner cartridge.

The toner storing container 63 is supported by a supporting member 70. One end of the nozzle 69 is inserted into the toner storing container 63 in the state that the toner storing container 63 is supported by the supporting member 70. The other end of the nozzle 69 is connected to an absorption opening 65*a* of the powder pump 65 by way of the toner tube 66.

The powder pump 65 has a rotor 71 of eccentric screw form and a stator 72 of double screws form and elastic material such as rubber. The rotor 71 is driven and rotated by driving force of a motor not illustrated in FIG. 8.

The supplying of toner by the toner supplying apparatus 62 is performed as follows. If it is judged that the supplying of toner is necessary, air in the air pump 73 is sent to the inside of the toner supplying container 63 by way of the air nozzle 68. At this time, the rotor 71 in the powder pump 65 also starts to rotate at the same time, and strong absorption force is generated in the powder pump 65.

Thereafter, the toner 63*a* in the toner storing container 63 which is fluid by the air stream from the air pump 73 is exhausted to the outside of the toner storing container 63 by the air pressure and the absorption force of the powder pump 65 etc., and is sent to the two components developing device 58 by way of the toner conveying tube 66 and the powder pump 65.

With respect to the supplying of toner by the toner supplying apparatus 62 described above, the toner is usually supplied to the inside of the two components developing device 58 on the basis of the change of the mixture ratio of the toner and the carrier, which is detected by the magnetic permeability detecting device.

In this embodiment, the toner amounts supplied from respective toner storing containers 63 to corresponding two components developing devices 58Y, 58M, 58C, and 58K, are set as the image forming condition.

When the supplying toner amount is set as the image forming condition, at first, the density detecting pattern 36 whose length in the sub scanning direction is set shorter than the interval length between the contacting portions of the intermediate transfer belt and the photoconductive members 19Y, 19M, 19C, and 19K, is formed on the photoconductive members 19Y, 19M, 19C, and 19K, respectively, in a similar manner as in the first embodiment. As a result, the function as the toner image forming device is realized.

The toner images of the density detecting pattern 36 formed on the photoconductive members 19Y, 19M, 19C, and 19K are transferred onto the intermediate transfer belt 59. As a result, the function as the transferring device is realized. After the transferring of the toner images from the photoconductive members 19Y, 19M, 19C, and 19K onto the intermediate transfer belt 59 before the tips of the toner images pass the respective contacting portions, the contact between photoconductive members 19Y, 19M, 19C, and 19K and the intermediate transfer belt 59 the force is decreased, so that a part of the each toner image transferred onto the intermediate transfer belt 59 is not transferred again onto the respective photoconductive members 19Y, 19M, 19C, and 19K, namely, the reverse transfer of the toner does not occur. As a result, the function as the contact force changing device is realized.

The density detecting sensor 32 detects the image densities of the toner images of respective colors formed on the intermediate transfer belt 59.

Figure 9:
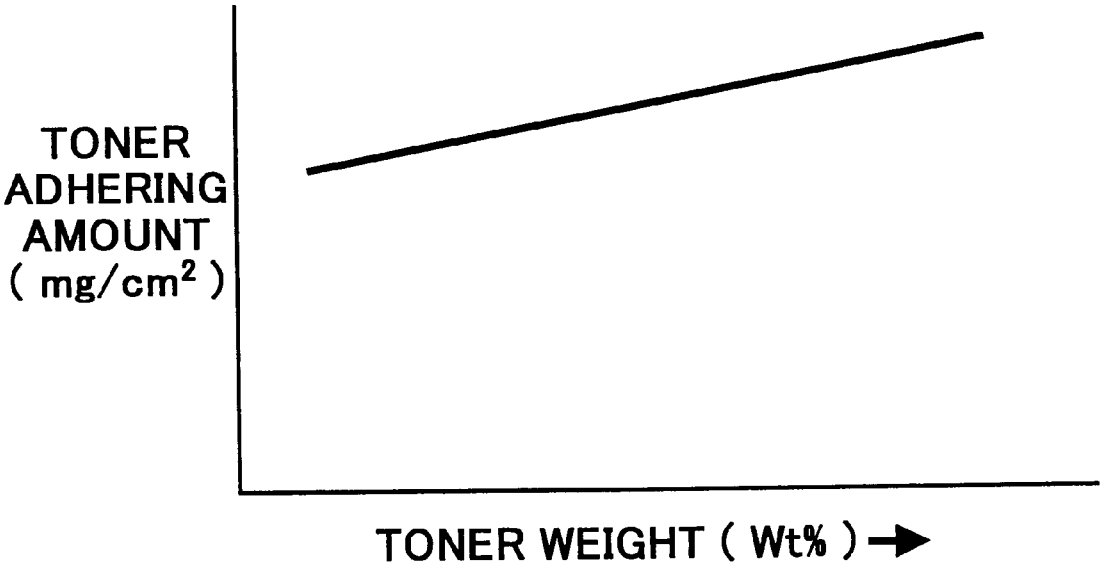
FIG. 9 is a correlation view illustrating relationship between a toner adhering amount and toner weight.

FIG. 9 is an explanation view illustrating the correlation between the toner weight in the two components developing devices 58Y, 58M, 58C, and 58K and the corresponding toner adhering amount. According to FIG. 9, it is understood that when the each developing bias of the two components developing devices 58Y, 58M, 58C, and 58K is fixed, the toner weight in the respective two components developing devices 58Y, 58M, 58C, and 58K is proportion to the corresponding toner adhering amount. Thereby, the relationship between the developing bias and the toner adhering amount can be constant by adjusting the toner amount which is supplied from the toner storing container 63 to the two components developing device 58 so that the toner adhering amount of the target is obtained. With respect to the correlation in FIG. 9, the correlation between the toner amount in the two components developing devices 58Y, 58M, 58C, and 58K and the toner adhering amount is previously obtained by experiments etc.

The image forming conditions of high reliability on the basis of the image density of toner images of the predetermined pattern in which the reverse transfer of toner has not occurred and which therefore has high reproducibility, can be set, and thereby the images, in which the reproducibility of density and color is stable, can be obtained.

According to one aspect of the present invention, the length of the predetermined pattern in the sub-scanning direction which the toner image forming devices form onto the respective image carriers and the transferring devices transfer onto the conveying member is set shorter than the interval length between the respective contacting portions of the conveying member and the respective image carriers, and further the contact force of the conveying member to the image carriers is decreased by the contact force changing device so that the reverse transfer of a part of the each toner image is not performed onto the respective image carriers before the tips of the toner images on the conveying member pass the respective contacting portions. Thereby, the toner images transferred from the plural image carriers are not overlapped on the conveying member, and the high reproducibility toner images of the predetermined pattern in which the reverse transfer has not occurred can be formed onto the conveying member. Thereby, for example, when the density sensor is installed as the image density detecting device, the toner images of the respective colors on the conveying member are detected by one density sensor, and therefore the high reproducibility images can be formed by an inexpensive structure without being influenced by the reverse transfer.

According to another aspect of the present invention, the image densities of the toner images of the predetermined pattern formed on the conveying member in the state that the reverse transfer has not occurred are detected by the image density detecting device, and the image forming conditions are set on the basis of the image densities by the image forming condition setting device. Thereby, the reliability of the set image forming conditions can be improved.

According to another aspect of the present invention, the image densities of the toner images transferred onto the conveying member are detected at each level such that the contact force is made different plural levels by the contact force adjusting mechanism, such that the conveying member contacts the image carriers and that the contact force of the conveying member to the image carriers is decreased, and the image forming conditions are set on the basis of the plural image densities detected at the each level. Thereby, the image forming conditions without the influence of the reverse transfer can be set. Thereby, the high reproducibility images without the influence of the reverse transfer can be formed.

According to another aspect of the present invention, the electric potential strengths of the transferring biases which are applied between the conveying member and the respective image carriers by the transferring devices, are set as the image forming conditions by the image forming condition setting device. Thereby, the image forming conditions without the influence of the reverse transfer, can be set. Thereby, the high reproducibility images without the influence of the reverse transfer can be formed.

According to another aspect of the present invention, the electric potential strengths of the developing biases which are applied between the developing devices and the respective image carriers by the developing devices, are set as the image forming conditions by the image forming condition setting device. Thereby, practically, the image forming conditions of high reliability on the basis of the image densities of the toner images of the predetermined pattern of the high reproducibility in which the reverse transfer has not occurred and which therefore has high reproducibility, can be set. Thereby, the images, in which the reproducibility of image density and color is stable, can be obtained.

According to another aspect of the present invention, the toner amounts supplied from the toner storing containers to the two components developing devices are set as the image forming conditions by the image forming condition setting device. Thereby, practically, the image forming conditions of high reliability on the basis of the image densities of the toner images of the predetermined pattern the in which the reverse transfer has not occurred and which therefore has high reproducibility, can be set. Thereby, the images, in which the reproducibility of image density and color is stable, can be obtained.

According to one aspect of the present invention, the length of the predetermined pattern in the sub-scanning direction which the toner image forming devices form onto the respective image carriers and the transferring devices transfer onto the intermediate transfer member is set shorter than the interval length between the respective contacting portions of the intermediate transfer member and the respective image carriers, and further the contact force of the intermediate transfer member to the image carriers is decreased by the contact force changing device so that the reverse transfer of a part of the each toner image is not performed onto the respective image carriers before the tips of the toner images on the intermediate transfer member pass the respective contacting portions. Thereby, the toner images transferred from the plural image carriers are not overlapped on the intermediate transfer member, and the high reproducibility toner images of the predetermined pattern in which the reverse transfer has not occurred can be formed onto the intermediate transfer member. Thereby, for example, when the density sensor is installed as the image density detecting device, the toner images of the respective colors on the intermediate transfer member are detected by one density sensor, and therefore the high reproducibility images can be formed by an inexpensive structure without being influenced by the reverse transfer.

According to another aspect of the present invention, the image densities of the toner images of the predetermined pattern formed on the intermediate transfer member in the state that the reverse transfer has not occurred are detected by the image density detecting device, and the image forming conditions are set on the basis of the image densities by the image forming condition setting device. Thereby, the reliability of the set image forming conditions can be improved.

According to another aspect of the present invention, the image densities of the toner images transferred onto the intermediate transfer member are detected at each level such that the contact force is made different plural levels by the contact force adjusting mechanism, such that the intermediate transfer member contacts the image carriers and that the contact force of the intermediate transfer member to the image carriers is decreased, and the image forming conditions are set on the basis of the plural image densities detected at the each level. Thereby, the image forming conditions without the influence of the reverse transfer can be set.

According to another aspect of the present invention, the electric potential strengths of the transferring biases which are applied between the intermediate transfer member and the respective image carriers by the transferring devices, are set as the image forming conditions by the image forming condition setting device. Thereby, the image forming conditions of high reliability on the basis of the image densities of the toner images of the predetermined pattern in which the reverse transfer has not occurred and which therefore has high reproducibility, can be set. Thereby, the high reproducibility images without the influence of the reverse transfer can be formed.

According to another aspect of the present invention, the electric potential strengths of the developing biases which are applied between the developing devices and the respective image carriers by the developing devices, are set as the image forming conditions by the image forming condition setting device. Thereby, practically, the image forming conditions of high reliability on the basis of the image densities of the toner images of the predetermined pattern in which the reverse transfer has not occurred and which therefore has high reproducibility, can be set. Thereby, the images, in which the reproducibility of image density and color is stable, can be obtained.

According to another aspect of the present invention, the toner amounts supplied from the toner storing containers to the two components developing devices are set as the image forming conditions by the image forming condition setting device. Thereby, practically, the image forming conditions of high reliability on the basis of the image densities of the toner images of the predetermined pattern in which the reverse transfer has not occurred and which therefore has high reproducibility, can be set. Thereby, the images, in which the reproducibility of image density and color is stable, can be obtained.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Application No. 2000-126757 filed on Apr. 27, 2000 and No. 2001-108253 filed on Apr. 6, 2001 in the Japanese Patent Office, the entire contents of which are hereby incorporated by reference.

What is claimed as new and is desired to be secured by Letters Patent of the United States is:

1. An image forming apparatus, comprising:

a conveying member configured to provide to a recording member a conveying force in a sub-scanning direction;

a plurality of image carriers configured to contact the conveying member with an interval between contacting portions of the plurality of image carriers and the conveying member;

a contact force adjusting mechanism configured to freely adjust a contact force of the conveying member to the plurality of image carriers between a predetermined contact force and a decreased contact force;

a plurality of toner image forming devices configured to form toner images of a predetermined pattern on the plurality of image carriers respectively, a length of the pattern in the sub-scanning direction being set shorter than a length of the interval;

a plurality of transferring devices configured to transfer the toner images on the plurality of image carriers onto the conveying member, respectively; and a contact force changing device configured to change the predetermined contact force to the decreased contact force before respective tips of the toner images on the conveying member pass subsequent contacting portions, so that respective parts of the toner images are not transferred onto subsequent image carriers.

2. The image forming apparatus of claim 1, further comprising:

an image density detecting device configured to detect image densities of the toner images on the conveying member; and an image forming condition setting device configured to set an image forming condition on a basis of the image densities detected by the image density detecting device.

3. The image forming apparatus of claim 2, wherein the image density detecting device detects the image densities of the toner images on the conveying member before and after the predetermined contact force by the contact force adjusting mechanism is changed to the decreased contact force, and the image forming condition setting device sets the image forming condition on a basis of the image densities detected by the image density detecting device before and after the predetermined contact force by the contact force adjusting mechanism is changed to the decreased contact force.

4. The image forming apparatus of claim 3, wherein the plurality of transferring devices transfer the toner images by applying transferring biases between the conveying member and the plurality of image carriers respectively, and the image forming condition setting device sets respective electric potential strengths of the transferring biases between the conveying member and the plurality of image carriers as the image forming condition.

5. The image forming apparatus of claim 2, wherein the plurality of toner image forming devices include the plurality of developing devices holding developer including toner, and form respectively the toner images by making the developer adhere to the plurality of image carriers by applying developing biases between the plurality of developing devices and the plurality of image carriers respectively, and the image forming condition setting device sets respective electric potential strengths of the developing biases between the plurality of developing devices and the plurality of image carriers as the image forming condition.

6. The image forming apparatus of claim 2, wherein the plurality of toner image forming devices include plurality of toner containers containing toner and plurality of developing devices holding developer including the toner supplied from the plurality of toner containers, and form the toner images by making the developer adhere to the plurality of image carriers by applying developing biases between the plurality of developing devices and the plurality of image carriers respectively, and the image forming condition setting device sets respective toner amounts supplied from the plurality of toner containers to the plurality of developing devices as the image forming condition.

7. An image forming apparatus, comprising:

an intermediate transfer member configured to rotate in a sub-scanning direction and to intermediately carry toner images to be transferred onto a conveyed recording member, arranged to oppose the conveyed recording member;

a plurality of image carriers configured to contact the intermediate transfer member with an interval between contacting portions of the plurality of image carriers and the intermediate transfer member;

a contact force adjusting mechanism configured to freely adjust a contact force of the intermediate transfer member to the plurality of image carriers between a predetermined contact force and a decreased contact force;

a plurality of toner image forming devices respectively configured to form toner images of a predetermined pattern on the plurality of image carriers respectively, a length of the pattern in the sub-scanning direction being set shorter than a length of the interval;

a plurality of transferring devices configured to transfer the toner images on the plurality of image carriers onto the intermediate transfer member respectively; and a contact force changing device configured to change the predetermined contact force to the decreased contact force before respective tips of the toner images on the intermediate transfer member respectively pass subsequent contacting portions, so that respective parts of the toner images are not transferred onto corresponding subsequent image carriers.

8. The image forming apparatus of claim 7, further comprising:

an image density detecting device configured to detect image densities of the toner images on the intermediate transfer member; and an image forming condition setting device configured to set an image forming condition on a basis of the image densities detected respectively by the image density detecting device.

9. The image forming apparatus of claim 8, wherein the image density detecting device detects the image densities of the toner images on the intermediate transfer member before and after the predetermined contact force by the contact force adjusting mechanism is changed to the decreased contact force, and the image forming condition setting device sets the image forming condition on a basis of the image densities detected by the image density detecting device before and after the predetermined contact force by the contact force adjusting mechanism is changed to the decreased contact force.

10. The image forming apparatus of claim 9, wherein the plurality of transferring devices transfer the toner images by applying transferring biases between the intermediate transfer member and the plurality of image carriers respectively, and the image forming condition setting device sets respective electric potential strengths of the transferring biases between the intermediate transfer member and the plurality of image carriers as the image forming condition.

11. The image forming apparatus of claim 8, wherein the plurality of toner image forming devices include developing devices holding developer including toner, and form the toner image by making the developer adhere to the plurality of image carriers by applying developing biases between the plurality of developing devices and the plurality of image carriers respectively, and the image forming condition setting device sets respective electric potential strengths of the developing biases between the plurality of developing devices and the plurality of image carriers as the image forming condition.

12. The image forming apparatus of claim 8, wherein the plurality of toner image forming devices include plurality of toner containers containing toner and plurality of developing devices holding developer including the toner supplied from the plurality of toner containers, and form the toner images by making the developer adhere to the plurality of image carriers by applying developing biases between the plurality of developing devices and the plurality of image carriers respectively, and the image forming condition setting device sets toner amounts supplied from the plurality of toner containers to the plurality of developing devices as the image forming condition.

13. An image forming apparatus, comprising:

means for providing to a recording member a conveying force in a sub-scanning direction;

a plurality of image carrying means for carrying toner images, contacting the conveying force providing means with an interval between contacting portions of the plurality of image carrying means and the conveying force providing means, respectively;

means for adjusting a contact force of the conveying force providing means to the plurality of image carrying means between a predetermined contact force and a decreased contact force;

a plurality of toner image forming means for forming the toner images of a predetermined pattern on the plurality of the image carrying means respectively, a length of the pattern in the sub-scanning direction being set shorter than a length of the interval;

a plurality of transferring means for transferring the toner images on the plurality of image carrying means onto the conveying force providing means respectively; and means for changing the predetermined contact force to the decreased contact force before respective tips of the toner images on the conveying force providing means pass subsequent contacting portions, so that respective parts of the toner images are not transferred onto subsequent image carrying means.

14. An image forming apparatus, comprising:

intermediate transferring means for intermediately carrying toner images to be transferred onto a recording member, arranged to oppose the recording member and to rotate in a sub-scanning direction;

a plurality of image carrying means for carrying the toner images, contacting the intermediate transferring means with an interval between contacting portions of the plurality of image carrying means and the intermediate transferring means, respectively;

means for adjusting a contact force of the intermediate transferring means to the plurality of image carrying means between a predetermined contact force and a decreased contact force;

a plurality of toner image forming means for forming toner images of a predetermined pattern on the plurality of image carrying means respectively, a length of the pattern in the sub-scanning direction being set shorter than a length of the interval;

a plurality of transferring means for transferring the toner images on the plurality of image carrying means onto the intermediate transferring means respectively; and means for changing the predetermined contact force to the decreased contact force before respective tips of the toner images on the intermediate transferring means pass subsequent contacting portions, so that respective parts of the toner images are not transferred onto subsequent image carrying means.

15. A method of forming an image with an image forming apparatus including a conveying member to provide to a recording member a conveying force in a sub-scanning direction, and a plurality of image carriers configured to contact the conveying member at a predetermined contact force with an interval between contacting portions of the plurality of image carriers and the conveying member, the method comprising:

forming toner images of a predetermined pattern on the plurality of image carriers respectively, a length of the pattern in the sub-scanning direction being set shorter than a length of the interval;

transferring the toner images onto the conveying member; and decreasing the predetermined contact force of the conveying member to the plurality of image carriers before respective tips of the toner images on the conveying member pass subsequent contacting portions, so that respective parts of the toner images are not transferred onto subsequent image carriers.

16. The method of forming an image of claim 15, further comprising:

detecting image densities of the toner images on the conveying member; and setting an image forming condition on a basis of the detected image densities.

17. The method of forming an image of claim 16, wherein the detecting of image densities includes detecting the image densities of the toner images on the conveying member before and after decreasing the predetermined contact force, and the setting of image forming condition sets the image forming condition on a basis of the image densities detected before and after decreasing the predetermined contact force.

18. The method of forming an image of claim 17, wherein the transferring of toner images transfers the toner images by applying transferring biases between the conveying member and the plurality of image carriers, and the setting of image forming condition sets respective electric potential strengths of the transferring biases between the conveying member and the plurality of image carriers as the image forming condition.

19. The method of forming an image of claim 16, wherein the forming of toner images includes making developer adhere to the plurality of image carriers by applying developing biases between plurality of developing devices and the plurality of image carriers, and the setting of image forming condition sets respective electric potential strengths of the developing biases between the plurality of developing devices as the image forming condition.

20. The method of forming an image of claim 16, the forming of toner images includes making developer adhere to the plurality of image carriers by applying developing biases between plurality of developing devices and the plurality of image carriers, and the setting of image forming condition sets respective toner amounts supplied from plurality of toner containers to the plurality of developing devices as the image forming condition.

21. A method of forming an image with an image forming apparatus including an intermediate transfer member to intermediately carry toner images to be transferred onto a conveyed recording member, arranged to oppose the conveyed recording member and to rotate in a sub-scanning direction, and a plurality of image carriers to contact the intermediate transfer member with an interval between contacting portions of the plurality of image carriers and the intermediate transfer member, the method comprising:

forming toner images of a predetermined pattern on the plurality of image carriers respectively, a length of the pattern in the sub-scanning direction being set shorter than a length of the interval;

transferring the toner images onto the intermediate transfer member; and decreasing the predetermined contact force of the intermediate transfer member to the plurality of image carriers before respective tips of the toner images on the intermediate transfer member pass subsequent contacting portions, so that respective parts of the toner images are not transferred onto subsequent image carriers.

22. The method of forming an image of claim 21, further comprising: detecting image densities of the toner images on the intermediate transfer member; and setting an image forming condition on a basis of the detected image densities.

23. The method of forming an image of claim 22, wherein the detecting of image densities includes detecting the image densities of the toner images on the intermediate transfer member before and after decreasing the predetermined contact force, and the setting of image forming condition sets the image forming condition on a basis of the image densities detected before and after decreasing the predetermined contact force.

24. The method of forming an image of claim 23, wherein the transferring of toner images transfers the toner images by applying transferring biases between the intermediate transfer member and the plurality of image carriers, and the setting of image forming condition sets respective electric potential strengths of the transferring biases between the intermediate transfer member and the plurality of image carriers as the image forming condition.

25. The method of forming an image of claim 22, wherein the forming of toner images includes making developer adhere to the plurality of image carriers by applying developing biases between plurality of developing devices and the plurality of image carriers, and the setting of image forming condition sets respective electric potential strengths of the developing biases between the plurality of developing devices and the plurality of image carriers as the image forming condition.

26. The method of forming an image of claim 22, the forming of toner images includes making developer adhere to the plurality of image carriers by applying developing biases between plurality of developing devices and the plurality of image carriers, and the setting of image forming condition sets respective toner amounts supplied from plurality of toner containers to the plurality of developing devices as the image forming condition.

* * * * *